US008192557B2

(12) United States Patent
Ryu et al.

(10) Patent No.: US 8,192,557 B2
(45) Date of Patent: Jun. 5, 2012

(54) DISH WASHING MACHINE WITH BASKET HEIGHT ADJUSTING APPARATUS

(75) Inventors: Jung Chan Ryu, Suwon-si (KR); Jae Young Choi, Suwon-si (KR); Yong Woon Han, Gunpo-si (KR); Sung Jin Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1001 days.

(21) Appl. No.: 11/798,161

(22) Filed: May 10, 2007

(65) Prior Publication Data

US 2008/0011337 A1 Jan. 17, 2008

(30) Foreign Application Priority Data

Jul. 12, 2006 (KR) ..... 10-2006-0065598

(51) Int. Cl.
*A47L 15/50* (2006.01)

(52) U.S. Cl. ..... 134/56 D; 134/57 D; 134/58 D; 134/147; 211/41.4; 211/41.8; 312/228.1

(58) Field of Classification Search ..... 134/56 D, 134/57 D, 58 D, 165, 172; 211/41.4, 41.8, 211/41.9; 312/228, 228.1, 311, 334.4, 351
See application file for complete search history.

(56) References Cited

U.S. PATENT DOCUMENTS

| | | | | |
|---|---|---|---|---|
| 3,734,589 | A * | 5/1973 | Morgan | 312/351 |
| 5,474,378 | A * | 12/1995 | Smith et al. | 312/334.4 |
| 5,595,200 | A * | 1/1997 | Favaro | 134/201 |
| 5,657,878 | A * | 8/1997 | Austin | 211/41.8 |
| 5,860,716 | A * | 1/1999 | Good et al. | 312/311 |
| 6,974,040 | B2 * | 12/2005 | Jahrling | 211/41.8 |
| 2003/0226580 | A1 * | 12/2003 | Welch | 134/172 |
| 2005/0001524 | A1 | 1/2005 | Deiss et al. | |
| 2005/0039782 | A1 * | 2/2005 | Kim | 134/58 D |
| 2006/0119236 | A1 * | 6/2006 | Dickson et al. | 312/311 |

FOREIGN PATENT DOCUMENTS

| | | |
|---|---|---|
| CN | 1711951 A | 12/2005 |
| KR | 100246395 | 12/1999 |
| KR | 10-2005-0019653 | 3/2005 |

OTHER PUBLICATIONS

Chinese Office Action issued Jun. 19, 2009 in corresponding Chinese Patent Application 200710108852.2.

* cited by examiner

*Primary Examiner* — Joseph L Perrin
*Assistant Examiner* — Benjamin Osterhout
(74) *Attorney, Agent, or Firm* — Staas & Halsey LLP

(57) ABSTRACT

A dish washing machine having a basket height adjusting apparatus. The dish washing machine includes a machine body having a washing tub defined therein, a basket disposed in the washing tub to receive dishes to be washed, and a basket height adjusting apparatus. The basket height adjusting apparatus includes a support bracket mounted at each side of the basket such that the support bracket can be moved vertically, rollers mounted to the support bracket to slide the basket forward and backward, and an adjusting lever mounted at the basket to adjust a vertical movement of the support bracket and to thereby adjust the height of the basket. The adjusting lever is moved along with the basket. Consequently, in the present invention, the thumb of a user is not caught in the basket and injured when the user rotates the adjusting lever.

21 Claims, 7 Drawing Sheets

DISH WASHING MACHINE WITH BASKET HEIGHT ADJUSTING APPARATUS

CROSS-REFERENCE TO RELATED APPLICATIONS

This application claims the benefit of Korean Patent Application No. 10-2006-0065598, filed on Jul. 12, 2006 in the Korean Intellectual Property Office, the disclosure of which is incorporated herein by reference.

BACKGROUND OF THE INVENTION

1. Field of the Invention

The present invention relates to a dish washing machine. More particularly, to a dish washing machine having a basket height adjusting apparatus.

2. Description of the Related Art

A conventional dish washing machine is a machine that injects high-pressure wash water to dishes to wash the dishes. The conventional dish washing machine includes a washing tub in which dishes are washed, upper and lower baskets mounted in the upper and lower parts of the washing tub, such that the upper and lower baskets can be slid forward and backward, to receive dishes, a sump to collect wash water used to wash the dishes, and a pump and nozzles to inject the wash water toward the interior of the washing tub.

Technologies for mounting a basket height adjusting apparatus in a dish washing machine to receive various kinds of dishes have been proposed.

The basket height adjusting apparatus is mounted at an upper basket to vertically adjust the height of the basket depending upon the size of dishes, thereby effectively receiving dishes in a washing tub having restricted space.

An example of a basket height adjusting apparatus includes a support bracket mounted at each side of a basket to receive dishes such that the support bracket can be moved vertically, rollers mounted to the support bracket to slide the basket along a rail fixed to each-side inner wall of a washing tub such that the rail extends in the forward-and-backward direction of the washing tub, and a handle to be rotated in the upward and downward direction by a user such that the basket can be caught by the support bracket and the basket can be released from the support bracket, whereby the basket can be moved upward and downward, as disclosed in Korean Unexamined Patent Publication No. 10-2005-0019653. The basket is constructed in a net structure in which a plurality of vertical bars (i.e., vertical ribs) and a plurality of horizontal bars (i.e., horizontal ribs) are arranged while being spaced apart from each other such that dishes can be received in the basket, and, at the same time, wash water having washed the dishes can flow to the bottom of the washing tub through the basket.

According to the above-mentioned disclosure, the height of the basket is adjusted as follows. A user accesses each side of the basket to grip the basket with some fingers (for example, the thumb and the index finger or the thumb, the index finger, and the middle finger) and to rotate the handle fixed to the support bracket through the net of the basket with some fingers (i.e., the middle finger or the ring finger). At this time, the basket is released from the support bracket. As a result, the basket is moved downward due to its weight, and the support bracket, which is mounted at the rail, is moved upward. Consequently, the height of the basket is raised.

In the conventional basket height adjusting apparatus, however, the handle which controls the basket such that the basket is caught by the support bracket and the basket is released from support bracket, is fixed to the support bracket which is moved relative to the basket, such that the handle moves along with the support bracket in an upward direction when the basket is moved downward. As a result, there is a possibility that the fingers (i.e., the middle finger or the ring finger) used to rotate the handle are caught between the horizontal bars of the basket moving downward at high speed due to its weight, and therefore, the fingers are injured.

Furthermore, the handle is mounted at the outside of the support bracket, and therefore, the handle is exposed to the outside. Consequently, a dish washing machine with such a basket height adjusting apparatus does not provide aesthetically pleasing external appearance.

SUMMARY OF THE INVENTION

Accordingly, it is an aspect of the present invention to provide a dish washing machine including an improved basket height adjusting apparatus to stably and easily adjust the height of a basket.

It is another aspect of the invention to provide a dish washing machine having an improved external appearance when the basket is withdrawn from a washing tub.

Additional aspects and/or advantages of the invention will be set forth in part in the description which follows and, in part, will be apparent from the description, or may be learned by practice of the invention.

The foregoing and/or other aspects of the present invention are achieved by providing a dish washing machine including a machine body having a washing tub disposed therein, a basket disposed in the washing tub to receive dishes to be washed, and a basket height adjusting apparatus including a support bracket mounted at each side of the basket such that the support bracket can be moved vertically, rollers mounted to the support bracket to slide the basket forward and backward, and an adjusting lever mounted at the basket to adjust the vertical movement of the support bracket, to thereby adjust the height of the basket, wherein a predetermined gap is defined between the upper end of the basket and a corresponding end of the adjusting lever and is constantly maintained when the support bracket is moved vertically.

According to an aspect of the present invention, the adjusting lever includes a catcher formed at one end thereof, to catch the support bracket and a handle formed at the other end thereof to rotate the catcher such that the support bracket is caught by the catcher and the support bracket is released from the catcher, and a predetermined gap defined between the handle and the upper end of the basket is constantly maintained when the support bracket is moved vertically as the adjusting lever is rotated.

According to an aspect of the present invention, the basket height adjusting apparatus further includes a guide cover to cover the adjusting lever.

According to an aspect of the present invention, the catcher includes an inclined surface to guide a movement of the support bracket and a catching protrusion at a lower end of the inclined surface to catch the support bracket, thereby preventing a downward movement of the basket relative to the support bracket.

According to an aspect of the present invention, the basket height adjusting apparatus further includes springs disposed between the catcher and an inner surface of the guide cover to elastically support the catcher.

The guide cover surrounds the adjusting lever such that the catcher is positioned inside the guide cover and the handle is positioned outside the guide cover, and the catcher is rotatably disposed in the guide cover.

According to an aspect of the present invention, The guide cover includes a rear cover coupled with the basket and a front cover to cover the rear cover such that the catcher is completely closed.

The rear cover includes fixing hooks and locating grooves formed at a rear thereof to detachably couple the guide cover with the basket, and the rear cover includes a stopper mounted therein to prevent the support bracket from being raised beyond a predetermined height when the support bracket is released from the catcher.

According to an aspect of the present invention, The adjusting lever is rotatable in a lateral direction of the basket.

The front cover of the guide cover includes a slit formed in one side thereof to guide a vertical movement of the support bracket.

It is another aspect of the present invention to provide a dish washing machine including a machine body having a washing tub disposed therein, a basket disposed in the washing tub to receive dishes to be washed, and a basket height adjusting apparatus including a support bracket mounted at each side of the basket, such that the support bracket can be moved vertically, to support the basket in the washing tub and an adjusting lever mounted at the basket to induce movement of the basket relative to the support bracket, to thereby adjust the height of the basket, wherein the adjusting lever is used to induce a relative movement between the basket and the support bracket when one end of the adjusting lever is rotated to an outside of the basket.

The adjusting lever includes a handle formed at the upper end thereof and a catcher formed at the other end thereof to catch the support bracket, wherein when the handle is rotated to the outside of the basket, the support bracket is released from the catcher with the result that the basket is moved downward from the support bracket.

The basket height adjusting apparatus further includes a guide cover, in which the adjusting lever is rotatably mounted. The guide cover is detachably coupled with the basket at a rear thereof, and the guide cover includes a slit formed in one side thereof to guide a vertical relative movement between the support bracket and the basket.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
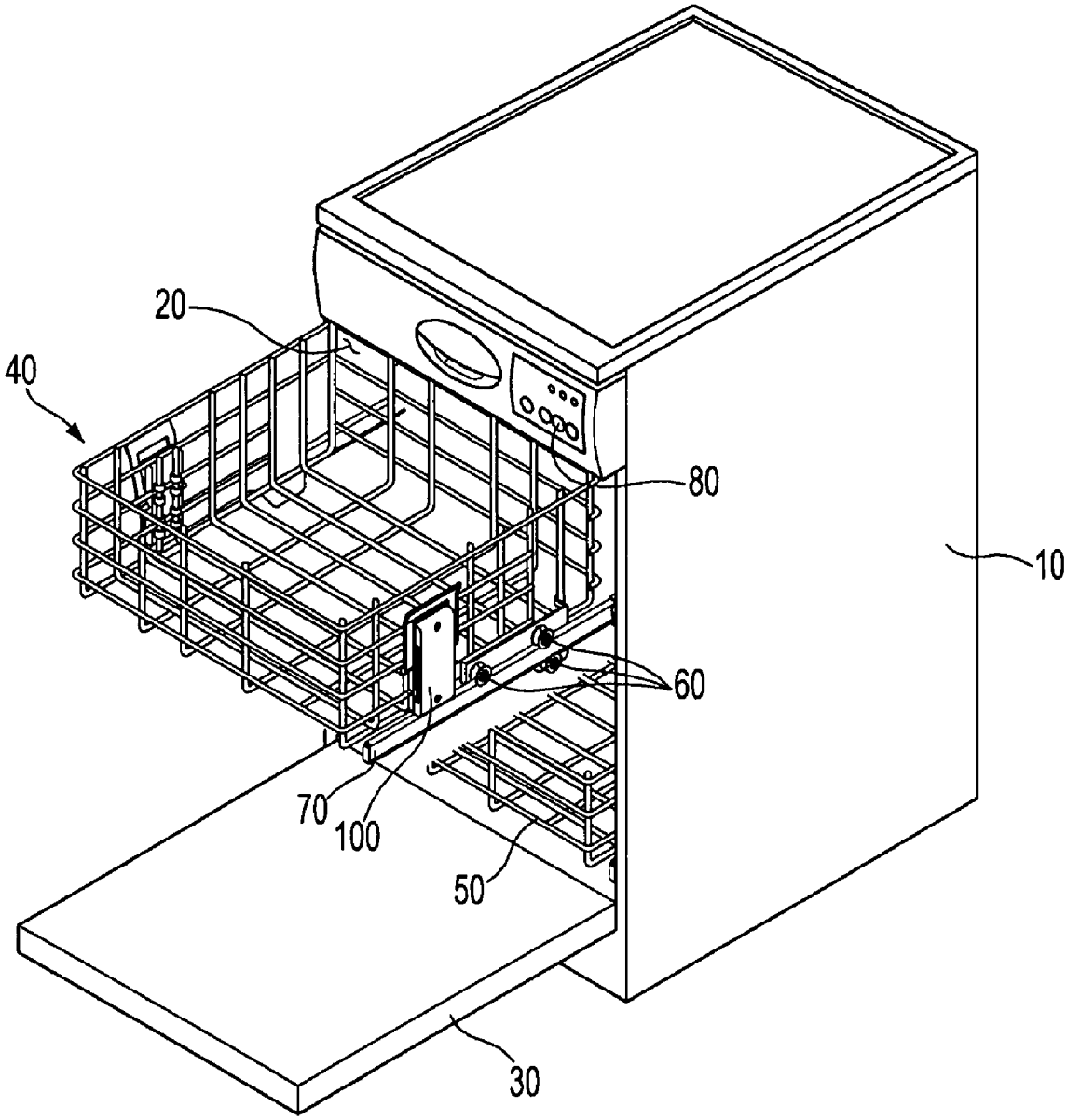
FIG. 1 is a perspective view of a dish washing machine according to an embodiment of the present invention.

Reference will now be made in detail to the embodiments of the present invention, examples of which are illustrated in the accompanying drawings, wherein like reference numerals refer to like elements throughout. The embodiments are described below to explain the present invention by referring to the figures.

FIG. 1 is a perspective view of a dish washing machine according to an embodiment of the present invention. As shown in FIG. 1, the dish washing machine comprises a machine body 10 forming an external appearance of the dish washing machine, a washing tub 20 opened at a front part thereof to form a dish washing space in the machine body 10, and a door 30 hingedly coupled with the front part of the machine body 10 to open and close the opening of the washing tub 20.

In the upper and lower parts of the washing tub 20 are mounted upper and lower baskets 40 and 50 to receive dishes, respectively. At outsides of the respective baskets 40 and 50 are mounted a plurality of rollers 60.

To the upper and lower parts of sidewalls of the washing tub 20 are fixed upper guide rails 70 and lower guide rails (not shown). The rollers 60 are slidably located on the upper guide rails 70 and the lower guide rails.

Consequently, the upper and lower baskets 40 and 50 can be slid forward and backward through a sliding movement between the upper/lower guide rails and the rollers.

At the upper end of the machine body 10, above the door 30, is disposed an input unit 80 to allow a user to input a command. In the machine body 10 is mounted a control unit (not shown) to control the operation of the dish washing machine based on a signal inputted from the input unit 80.

Although not shown in the drawings, water injection nozzles are disposed in the washing tub 20 to inject wash water to dishes, a sump is mounted at a lower end of the machine body 10 to collect wash water, and a circulation pump is mounted at the lower end of the machine body to supply wash water collected in the sump to the water injection nozzles.

Figure 2:
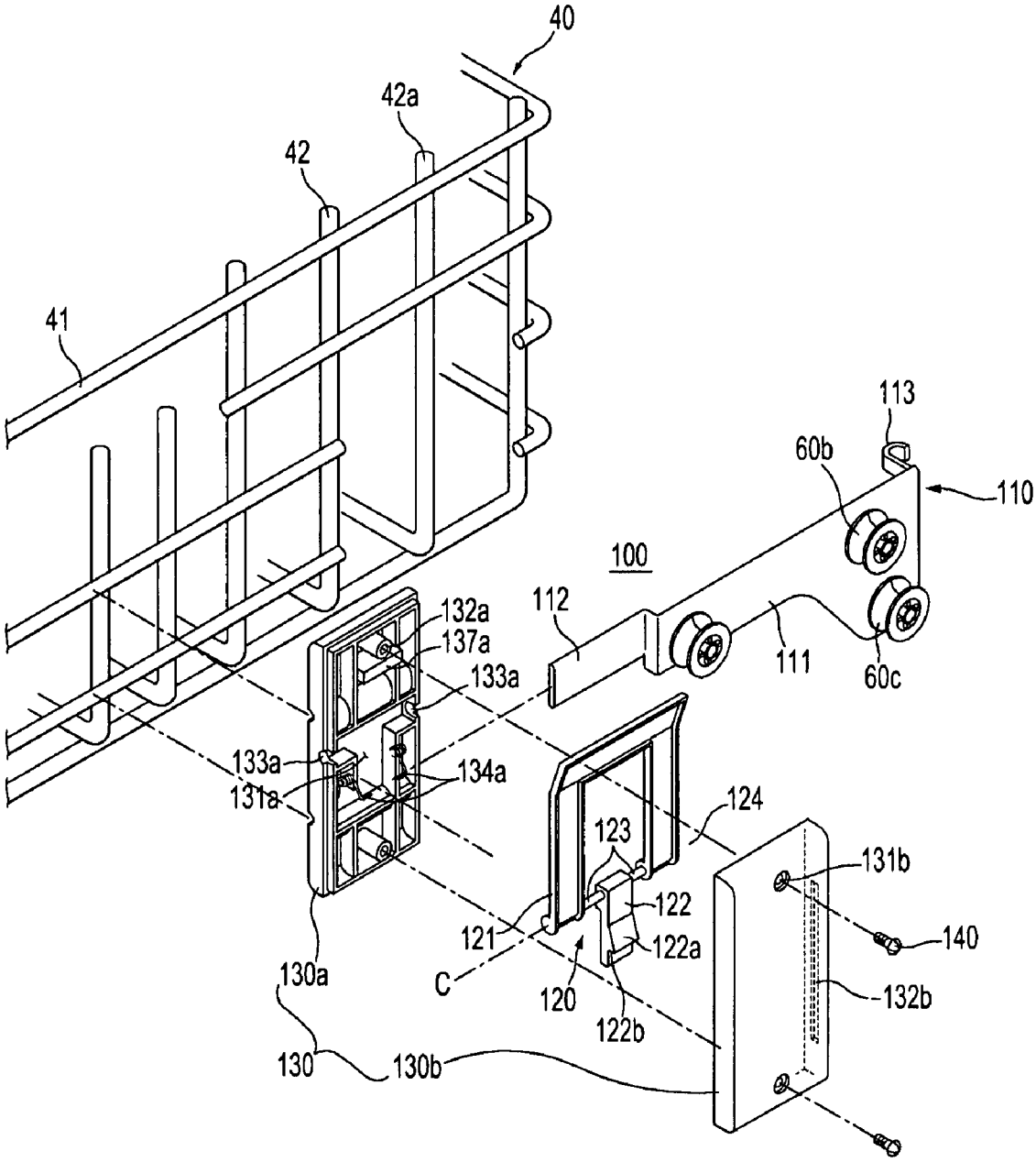
FIG. 2 is an exploded perspective view illustrating a basket height adjusting apparatus according to an embodiment of the present invention as shown in FIG. 1.

FIG. 2 is an exploded perspective view illustrating a basket height adjusting apparatus 100 according to an embodiment of the present invention. As shown in FIG. 2, the basket height adjusting apparatus 100 includes a support bracket 110 mounted at one side of the upper basket 40 to support the upper basket 40 in the washing tub, an adjusting lever 120 to adjust a vertical movement of the support bracket 110, and a guide cover 130 coupled with the upper basket 40 to cover the adjusting lever 120.

As will be described below in detail, the support bracket 110 and the upper basket 40 are constructed such that a relative movement can be performed vertically between the support bracket 110 and the upper basket 40. Consequently, a user can adjust the height of the basket 40 depending upon the size of dishes.

According to an embodiment of the present invention, the basket height adjusting apparatus 100 is mounted at each side of the upper basket 40. When large-sized dishes are to be washed, the upper basket 40 is moved downward toward a lower end of the washing tub 20. As a result, an upper space of the upper basket 40 is increased, and therefore, it is possible to receive the large-sized dishes in the upper basket 40.

The upper basket 40 is constructed in a net structure in which a plurality of vertical bars (i.e., vertical ribs) 42 and a plurality of horizontal bars (i.e., horizontal ribs) 41 are arranged while being spaced a predetermined distance from each other such that dishes can be received in the upper basket 40, and, at the same time, wash water having washed the dishes can flow to the bottom of the washing tub 20 through the upper basket 40.

As described above, the support bracket 110 is constructed such that the relative movement can be performed vertically between the support bracket 110 and the upper basket 40. The support bracket 110 is formed in the shape of a plate.

The support bracket 110 comprises a bracket body 111 having the plurality of rollers 60, which roll along the guide rail 70 (see FIG. 1) to slide the upper basket 40 into the washing tub 20, mounted thereto, and an extension 112 extending laterally from the bracket body 111. The extension 112 is fitted in the guide cover 130 such that the extension 112 is caught by a catcher 122 disposed at an end of the adjusting lever 120, or is released from the catcher 122, as the adjusting lever 120 is rotated.

The rollers 60 are mounted to an outside of the bracket body 111. Specifically, three rollers 60 are mounted to the outside of the bracket body 111 in the shape of a "¬"as shown in FIG. 1. The rollers 60 comprise front and rear upper rollers 60*a* and 60*b* mounted at the front and rear upper parts of the bracket body 111 such that the front and rear upper rollers 60*a* and 60*b* can roll along the upper part of the guide rail 70 (see FIG. 1) and a rear lower roller 60*c* mounted right below the rear upper roller 60*b* such that the rear lower roller 60*c* can roll along the lower part of the guide rail 70.

At upper and lower parts of a side of the bracket body 111 opposite to the extension 112 are formed supporting parts 113, which are bent in a shape of a semicircle. The supporting parts 113 surround an outer circumference of a vertical guide bar 42*a* of the basket 40 and are coupled with the vertical guide bar 42*a* in a forcible fitting fashion to support the bracket body 111 such that the bracket body 111 can be moved vertically.

The guide cover 130 comprises a rear cover 130*a* formed approximately in a shape of a rectangle and coupled with the upper basket 40, and a front cover 130*b* to cover the rear cover 130*a* such that a closed space is formed therebetween.

At the upper and lower outside parts of the rear cover 130*a* are formed fixing hooks (see FIG. 3) and locating grooves (see FIG. 3), by which the rear cover 130*a* is detachably coupled to the horizontal bars 41 and the vertical bars 42 of the basket 40. The fixing hooks and the locating grooves will be described below.

At the upper and lower inside parts of the rear cover 130*a* are formed bolt grooves 132*a*, in which bolts 140 are threadedly engaged to accomplish the coupling between the rear cover 130*a* and the front cover 130*b*. At the middle inside part of the rear cover 130*a* is formed a catcher locating groove 131*a*, in which the catcher 122 of the adjusting lever 120 is located.

At opposite sides of the catcher locating groove 131*a* are mounted compression springs 134*a* to elastically support the catcher 122. The compression springs 134 return the catcher 122 of the adjusting lever 120 to its original position after an external force to rotate the catcher 122 of the adjusting lever 120 is released.

In the middle parts of opposite sides of the rear cover 130*a* are formed hinge holes 133*a*, in which a hinge shaft 123 of the adjusting lever 120 is rotatably engaged.

Above the catcher locating groove 131*a* is disposed a stopper 137*a* to prevent the support bracket 110 from being raised beyond a predetermined height when the support bracket 110 is raised (or the upper basket 40 is lowered) as the extension 112 of the support bracket 110 is released from the catcher 122 by the rotation of the adjusting lever 120.

In the upper and lower parts of the front cover 130*b* are formed through-holes 131*b*, which correspond to the bolt grooves 132*a* such that the bolts 140 can be threadedly inserted into the bolt grooves 132*a* through the through-holes 131*b*. In one side of the front cover 130*b* is formed a vertical slit 132*b*, through which the extension 112 of the support bracket 111 is inserted such that the bracket 111 can be moved in the top-and-bottom direction of the upper basket 40.

The adjusting lever 120 comprises the catcher 122 to catch the extension 112 of the support bracket 110, a handle 121 to rotate the catcher 122 such that the extension 112 of the support bracket 110 can be caught by the catcher 122 or the extension 112 of the support bracket 110 can be released from the catcher 122, a hinge shaft 123 hingedly engaged in the hinge holes 133*a* of the rear cover 130*a*.

The catcher 122 and the handle 121 are opposite to each other from a center line 'C' extending through a center of the hinge shaft 123. Specifically, the catcher 122 is disposed in the guide cover 130, and therefore, the catcher 122 is not exposed to the outside of the guide cover 130. The handle 121 is disposed at the outside of the guide cover 130, and therefore, the handle 121 can be easily operated by a user.

The handle 121 is formed in the shape of a "Π"to surround the guide cover 130. However, the present invention is not limited to the handle 121 being formed of a particular shape, thus, any suitable shape may be used.

The catcher 122 comprises a downwardly inclined surface 122*a* and a catching protrusion 122*b* formed at a lower end of the inclined surface 122*a*.

The inclined surface 122*a* guides the extension 112 of the support bracket 110, such that the extension 112 is lowered along the inclined surface 122*a*, when a user lifts the upper basket 40 upward.

When the adjusting lever 120 is returned to its original position by the compression springs 134*a*, the catching protrusion 122*b* catches the extension 112 of the support bracket 110 to prevent the support bracket 110 from being raised.

Figure 3:
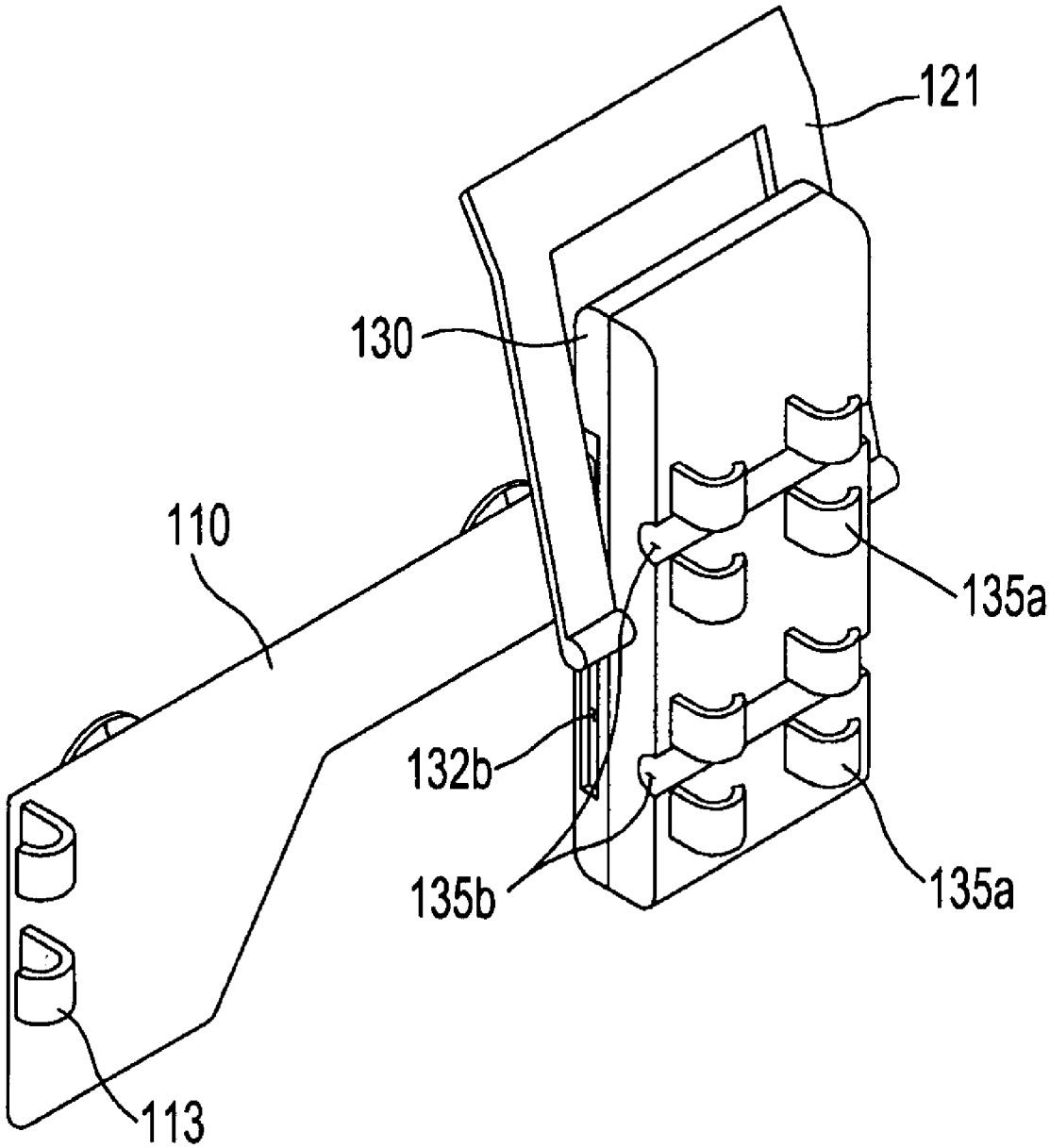
FIG. 3 is an assembled perspective view illustrating a rear part of the basket height adjusting apparatus according to an embodiment of the present invention as shown in FIG. 1.

As shown in FIG. 3, fixing hooks 135*a* and locating grooves 135*b* are formed at a rear of the guide cover 130 such that the fixing hooks 135*a* and the locating grooves 135*b* are coupled with the upper basket 40. Specifically, the fixing hooks 135*a* are coupled with the vertical bars 42, and the locating grooves 135*b* are coupled to the horizontal bars 41.

Hereinafter, an operation of the basket height adjusting apparatus according to an embodiment of the present invention will be described in detail with reference to the drawings.

Figure 4A:
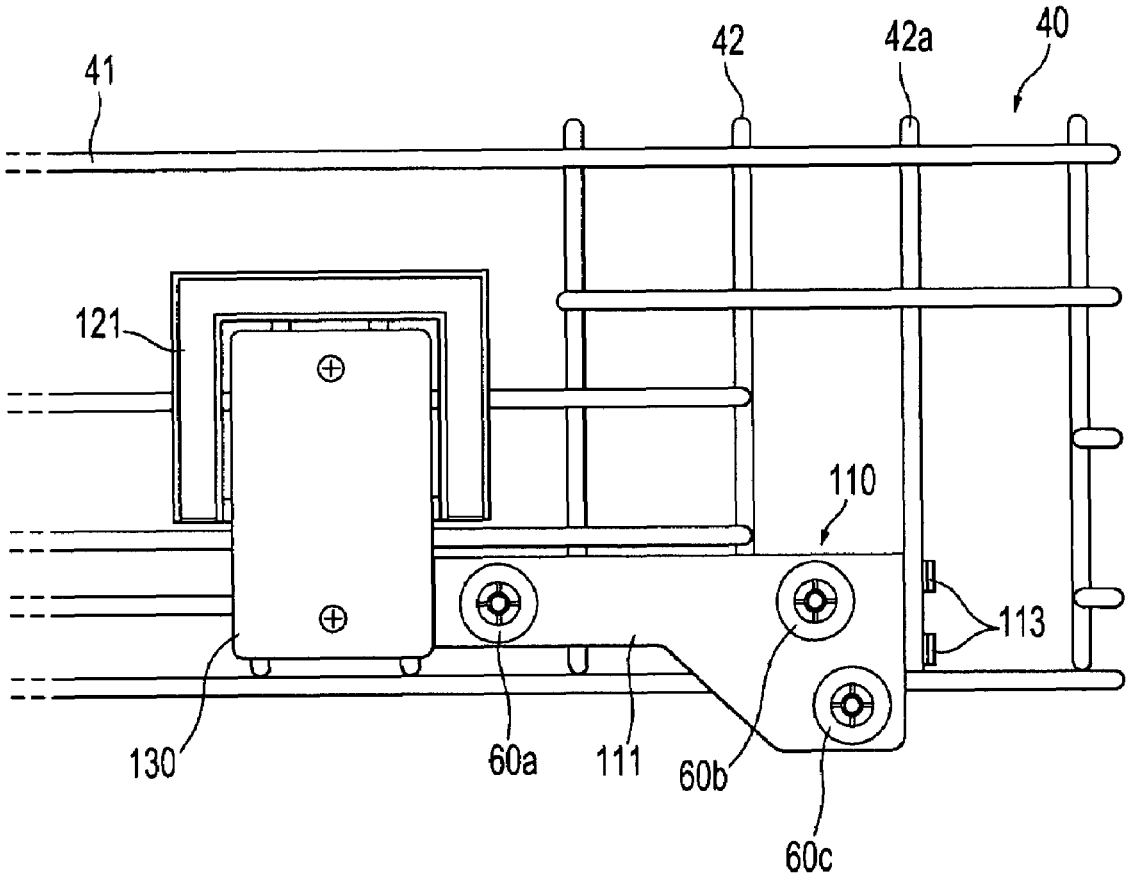
FIG. 4A is a side view illustrating a basket raised by the basket height adjusting apparatus according to an embodiment of the present invention as shown in FIG. 1.
Figure 4B:
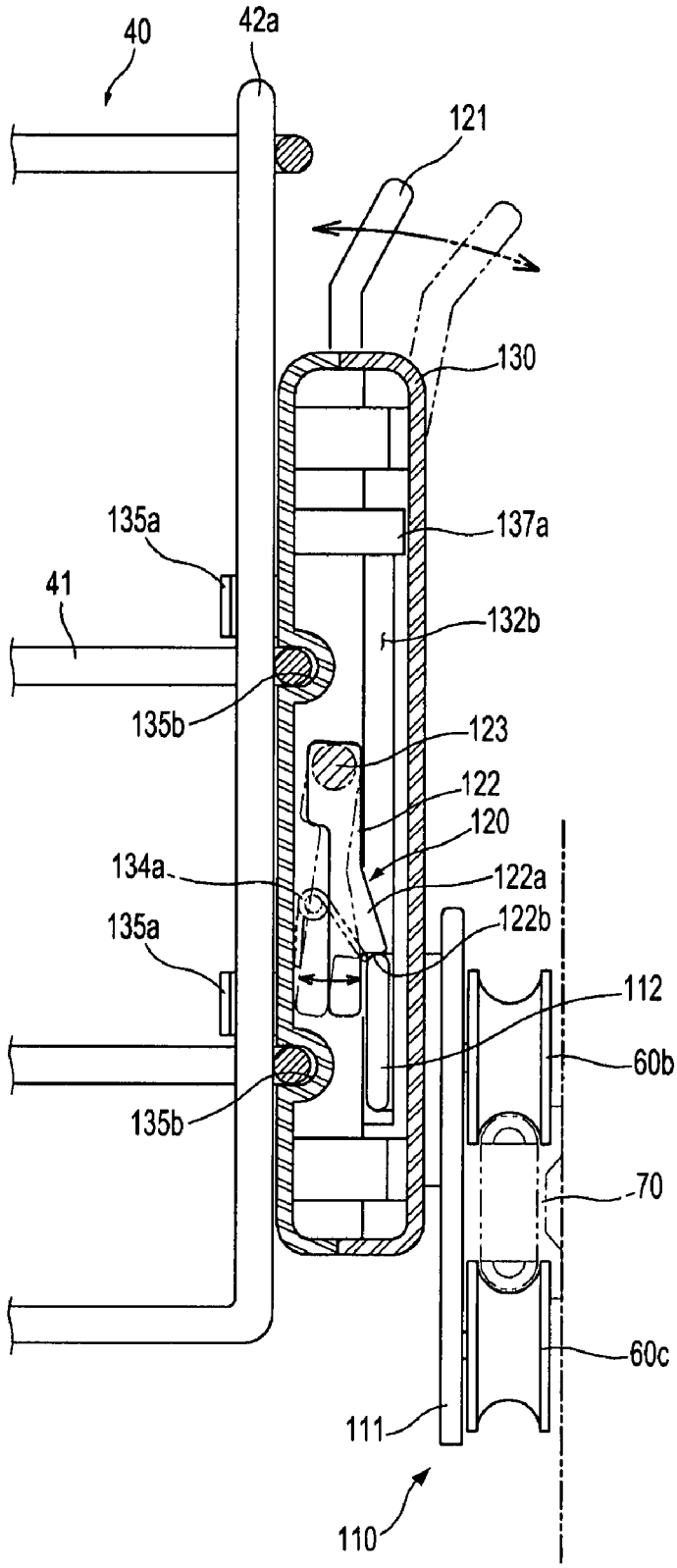
FIG. 4B is a sectional view of the basket height adjusting apparatus according to an embodiment of the present invention as shown in FIG. 4A.
Figure 5A:
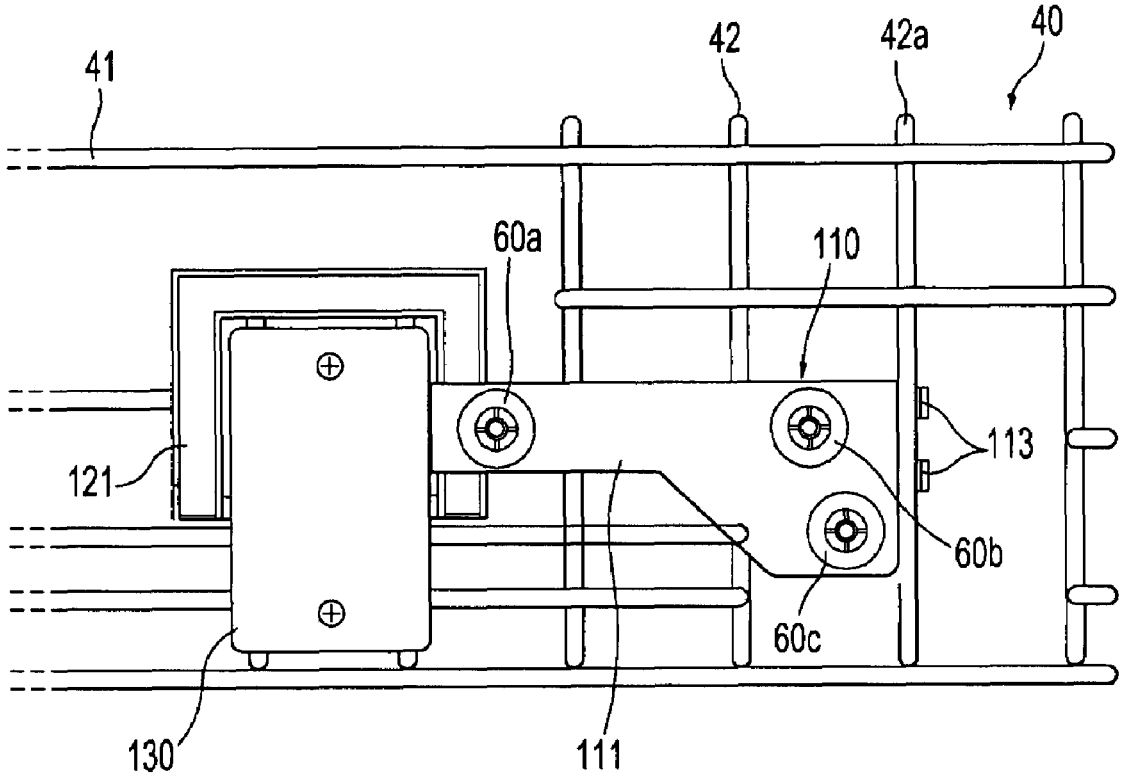
FIG. 5A is a side view illustrating a basket lowered by the basket height adjusting apparatus according to an embodiment of the present invention as shown in FIG. 1.
Figure 5B:
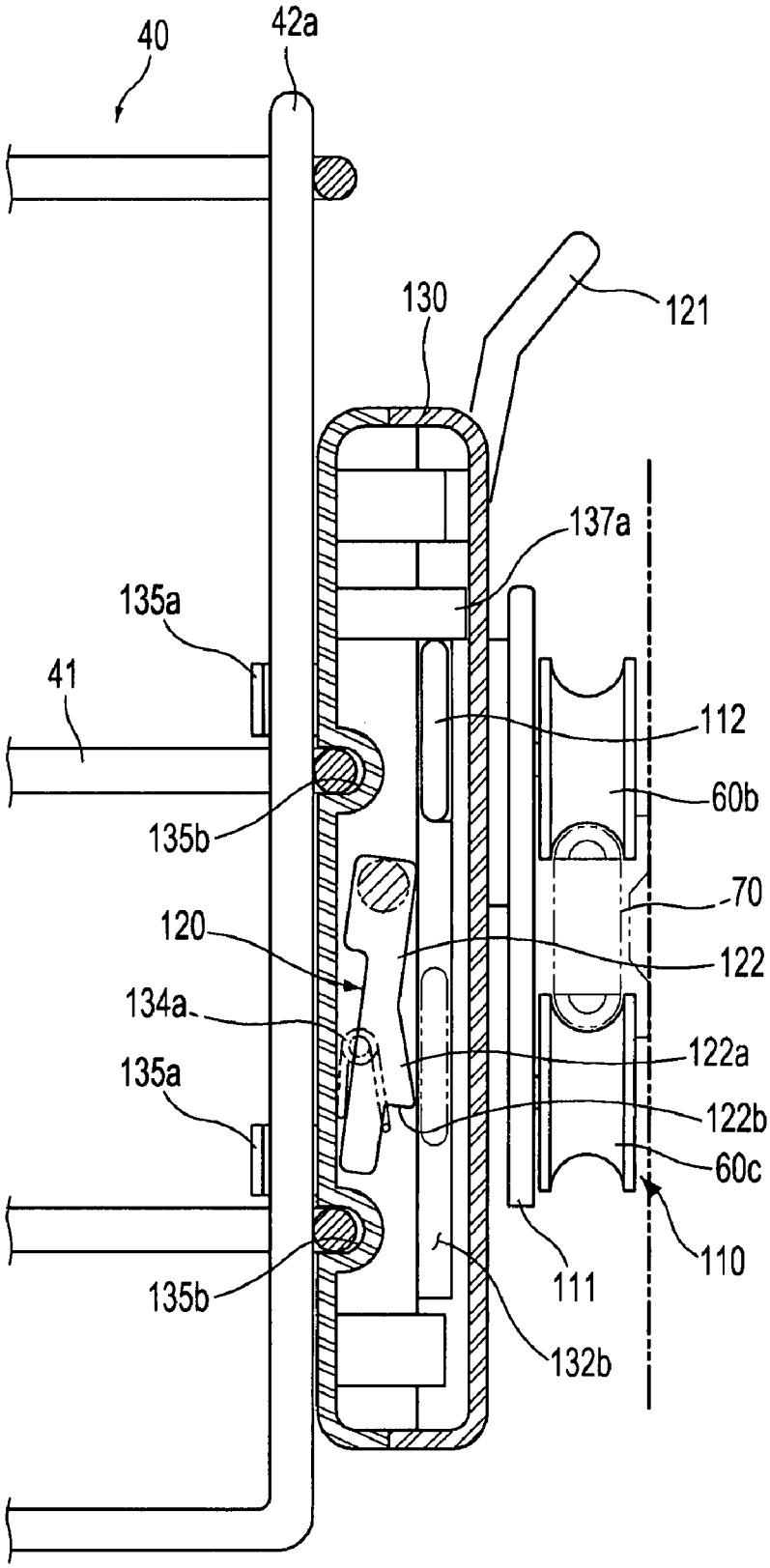
FIG. 5B is a sectional view of the basket height adjusting apparatus according to an embodiment of the present invention as shown in FIG. 5A.

FIGS. 4A and 4B are a side view and a sectional view illustrating the rail being located at the lower part of the upper basket by the basket height adjusting apparatus according to the present invention with the result that the upper basket is raised. FIGS. 5A and 5B are a side view and a sectional view illustrating the rail being located at the upper part of the upper basket by the basket height adjusting apparatus according to the present invention with the result that the upper basket is lowered.

As shown in FIGS. 4A and 4B, the guide cover 130 is fixed to the upper basket 40. The extension 112 of the support bracket 110 is inserted through the slit 132*b* of the guide cover 130 and is caught by the catching protrusion 122*b* of the catcher 122.

The supporting parts 113 of the support bracket 110 are elastically fitted on the vertical guide bar 42*a*. Consequently, the support bracket 110 is coupled with the basket 40 such that the support bracket 110 can be moved vertically.

The rollers 60*a*, 60*b*, and 60*c* mounted to the bracket body 111 of the support bracket 110 roll along the guide rail 70, while being supported by the guide rail 70, to slide the basket 40 forward and backward.

First, a method of lowering the upper basket 40 (such that the basket is disposed relatively in the lower part of the washing tub) to wash large-sized dishes in the state that the height of the basket 40 is upwardly adjusted (in the state that the basket 40 is disposed relatively in the upper part of the washing tub) will now be described.

When a user holds the front part of the upper basket 40 and pulls the upper basket 40 forward, the rollers 60*a*, 60*b*, and 60*c* mounted to the support bracket 110 roll forward along the guide rail 70, and therefore, the upper basket 40 is withdrawn from the machine body 10.

In this state, the user accesses each side of the upper basket 40 to grip the horizontal bars 41 with fingers excluding the thumb, and to rotate the handle 121 of the adjusting lever to the outside of the upper basket 40 using the thumb.

As a result, as shown in FIGS. 5A and 5B, the extension 112 is released from the catching protrusion 122*b*, and the basket 40 is moved downward relative to the support bracket 110 due to the weight of the basket 40 including dishes received in the basket 40. That is, the support bracket 110 having the supporting parts 113 mounted thereto is moved upward relative to the upper basket 40 along the slit 132*b*.

Consequently, the upper basket 40 is located at a position lower than an initial position in the washing tub.

This vertical relative movement is accomplished between the upper basket 40 and the support bracket 110. The guide cover 130 is fixed to the basket 40 by the fixing hooks 135*a* and the locating grooves 135*b*.

As long as the adjusting lever 120 is rotatably coupled with the guide cover 130, the height of the adjusting lever 120 is determined based upon the guide cover 130 and the basket 40.

Consequently, a predetermined gap is defined between the handle 121 and the upper end of the upper basket 40 and is constantly maintained when the support bracket 110 is moved vertically as the handle 121 of the adjusting lever 120 is rotated.

The thumb of the user is positioned in the predetermined gap. Consequently, there is no possibility that the thumb of the user is caught in the gap and is injured when the upper basket 40 is moved vertically as long as the gap is constantly maintained.

In order to move the upper basket 40 upward when the upper basket 40 is in a lowered position, as shown in FIGS. 4A and 4B, the user lifts the upper basket 40 upward without rotating the handle 121 of the adjusting lever 120.

When the basket 40 is lifted upward, the catcher 122 disposed in the guide cover 130 is moved upward. As a result, the inclined surface 122*a* of the catcher 122 is brought into contact with the extension 112 of the support bracket 111, and therefore, the catcher 122 is moved toward the compression springs 134*a*.

Subsequently, the inclined surface 122*a* passes the extension 112, and the catching protrusion 122*b* reaches the extension 112. At this time, the catcher 122 is pushed due to an elastic force of the compression springs 134*a*, and therefore, the catching protrusion 122*b* is brought into contact with the upper end of the extension 112.

After the upward movement of the basket 40 is completed, the downward movement of the basket 40 due to the weight thereof is prevented by the catching action accomplished between the catching protrusion 122*b* and the upper end of the extension 112.

As apparent from the above description according to an embodiment of the present invention, the adjusting lever to adjust the height of the basket is coupled with the basket such that the adjusting lever can be moved along with the basket. Consequently, when the basket is rapidly lowered due to the weight of the basket including dishes placed therein as the adjusting lever is rotated by the thumb of a user, there is no possibility that the thumb of the user is caught in the basket and is injured.

Furthermore, the catcher of the adjusting lever is covered by the guide cover such that the catcher is not exposed to the outside. Consequently, the external appearance of the dish washing machine is improved when the basket is withdrawn from the washing tub of the dish washing machine.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A dish washing machine comprising:

a machine body having a washing tub disposed therein;

a basket disposed in the washing tub to receive dishes to be washed; and a basket height adjusting apparatus comprising:

a support bracket mounted at each side of the basket such that the support bracket can be moved vertically;

rollers mounted to the support bracket to slide the basket forward and backward, an adjusting lever mounted at the basket to adjust a vertical movement of the support bracket, to thereby adjust a height of the basket, the adjusting lever including a catcher to catch the support bracket; and a guide cover to cover the adjusting lever, wherein the support bracket having a bracket body including the rollers, and an extension extending laterally from one end of the bracket body, wherein a predetermined gap is defined between an upper end of the basket and the corresponding end of the adjusting lever and is constantly maintained when the support bracket is moved vertically, and the extension of the support bracket is caught and released by the catcher, wherein the guide cover comprises a slit formed in one side, which is close-ended, such that the extension of the support bracket is inserted horizontally into the slit, to guide the vertical movement of the support bracket, and wherein the catcher catches a distal end of the extension which is inserted horizontally into the slit to extend toward the closed-end of the guide cover.

2. The dish washing machine according to claim 1, wherein the adjusting lever further comprises a handle formed at one end thereof to rotate the catcher such that the support bracket is caught by the catcher and the support bracket is released from the catcher, and a predetermined gap is defined between the handle and the upper end of the basket and is constantly maintained when the support bracket is moved vertically as the adjusting lever is rotated.

3. The dish washing machine according to claim 1, wherein the catcher comprises an inclined surface to guide a movement of the support bracket and a catching protrusion formed at a lower end of the inclined surface to catch the support bracket, thereby preventing a downward movement of the basket relative to the support bracket.

4. The dish washing machine according to claim 2, wherein the basket height adjusting apparatus further comprises springs disposed between the catcher and an inner surface of the guide cover to elastically support the catcher.

5. The dish washing machine according to claim 2, wherein the guide cover encloses the adjusting lever such that the catcher is positioned inside the guide cover and the handle is positioned outside the guide cover, and the catcher is rotatably disposed in the guide cover.

6. The dish washing machine according to claim 5, wherein the guide cover comprise a rear cover coupled with the basket and a front cover to cover the rear cover such that the catcher is completely closed.

7. The dish washing machine according to claim 6, wherein the rear cover comprises fixing hooks and locating grooves formed at a rear thereof to detachably couple the guide cover to the basket, and the rear cover comprises a stopper mounted therein to prevent the support bracket from being raised beyond a predetermined height when the support bracket is released from the catcher.

8. The dish washing machine according to claim 5, wherein the adjusting lever is rotated in a lateral direction of the basket.

9. A dish washing machine comprising:

a machine body having a washing tub disposed therein;

a basket disposed in the washing tub to receive dishes to be washed; and a basket height adjusting apparatus comprising:

a support bracket mounted at each side of the basket, such that the support bracket can be moved vertically, to support the basket in the washing tub;

an adjusting lever mounted at the basket to induce movement of the basket relative to the support bracket, to thereby adjust the height of the basket, the adjusting lever including a catcher to catch the support bracket; and a guide cover to cover the adjusting lever, wherein the adjusting lever is used to induce a relative movement between the basket and the support bracket when one end of the adjusting lever is rotated to the outside of the basket, wherein the support bracket having a bracket body including an extension extending laterally from one end of the bracket body, wherein the guide cover comprises a slit formed in one side, which is close-ended, such that the extension of the support bracket is inserted horizontally into the slit, to guide the vertical relative movement between the support bracket and the basket, and wherein the catcher catches a distal end of the extension which is inserted horizontally into the slit to extend toward the closed-end of the guide cover.

10. The dish washing machine according to claim 9, wherein the adjusting lever comprises a handle formed at an upper end thereof, and the catcher formed at the other end thereof to catch the support bracket, and when the handle is rotated to an outside of the basket, the support bracket is released from the catcher such that the basket is moved downward from the support bracket.

11. The dish washing machine according to claim 9, wherein the basket height adjusting apparatus further comprises a guide cover, in which the adjusting lever is rotatably mounted, and wherein the guide cover is detachably coupled with the basket at a rear thereof.

12. A dish washing machine having a washing tub, comprising:

a basket to hold dishes to be washed; and a basket height adjusting apparatus connected with the basket to adjust a height of the basket, the basket height adjusting apparatus comprising:

a support bracket mounted at a side of the basket to support the basket, the support bracket including a bracket body having a plurality of rollers, and an extension extending laterally from one end of the bracket body; and an adjusting lever to adjust a vertical movement of the support bracket relative to the adjusting lever, such that the basket moves in a vertical direction when the vertical movement of the support bracket is adjusted, to thereby adjust the height of the basket, the adjusting lever including a catcher to catch the support bracket, the extension of the support bracket being caught and released by the catcher, and a guide cover coupled with the basket to cover the adjusting lever, wherein the guide cover comprises a slit formed in one side, which is close-ended, such that the extension of the support bracket is inserted horizontally into the slit, to guide the vertical relative movement between the support bracket and the basket, and wherein the catcher catches a distal end of the extension which is inserted horizontally into the slit to extend toward the closed-end of the guide cover.

13. The dish washing machine of claim 12, wherein a predetermined gap is defined between an upper end of the basket and a corresponding end of the adjusting level and is constantly maintained when the support bracket is moved vertically.

14. The dish washing machine of claim 13, wherein the adjusting lever further comprises a handle at an end thereof to rotate the catcher such that the support bracket is caught by the catcher to prevent a downward movement of the basket, and released by the catcher to move the basket upwardly and downwardly.

15. The dish washing machine of claim 14, wherein the basket comprises vertical bars and horizontal bars, and a vertical guide bar to guide the support bracket; and the support bracket comprises:

the bracket body having the plurality of rollers, which roll along a guide rail of the dish washing machine to thereby slide the basket in and out of the washing tub, the extension extending laterally from the one end of the bracket body and fitted in the guide cover such that the extension is caught and released by the catcher, and supporting parts formed at upper and lower parts of a side of the bracket body opposite to the extension and bent in a shape of a semicircle to be elastically fitted on the vertical guide bar of the basket such that the support bracket is movable vertically.

16. The dish washing machine of claim 15, wherein the guide cover comprises:

a rear cover coupled with the basket and a front cover having the slit, which is close-ended, in which the extension is fitted horizontally, and covering the rear cover such that a closed space is formed therebetween, and the rear cover comprises a catcher locating groove at a middle inside part wherein the catcher is disposed, and compression springs mounted at opposite sides of the catcher locating groove to elastically support the catcher.

17. The dish washing machine of claim 16, wherein the compression springs return the catcher to its original position after an external force rotating the catcher is released.

18. The dish washing machine of claim 16, wherein the rear cover further comprises a stopper to prevent the support bracket from being raised beyond a predetermined height when the support bracket is moved in a vertical direction and the basket is lowered, as the extension of the supporting bracket is released from the catcher by a rotation of the adjusting lever.

19. The dish washing machine of claim 18, wherein the catcher comprises a downwardly inclined surface and a catching protrusion formed at a lower end of the inclined surface wherein the inclined surface guides the extension of the support bracket and the extension is lowered along the inclined surface when a user lifts the basket upward.

20. The dish washing machine of claim 19, wherein when the adjusting lever returns to its original position by the compression springs, the catching protrusion catches the extension to prevent the support bracket from being raised.

21. The dish washing machine of claim 16, wherein the guide cover further comprises fixing hooks and locating grooves formed at a rear exterior side of the guide cover, wherein the fixing hooks are coupled with the vertical bars of the basket and the locating grooves are coupled with the horizontal bars of the basket.

* * * * *

UNITED STATES PATENT AND TRADEMARK OFFICE

CERTIFICATE OF CORRECTION

PATENT NO. : 8,192,557 B2
APPLICATION NO. : 11/798161
DATED : June 5, 2012
INVENTOR(S) : Jung Chan Ryu et al.

It is certified that error appears in the above-identified patent and that said Letters Patent is hereby corrected as shown below:

Column 10, Line 37, In Claim 13, delete "level" and insert -- lever --, therefor.

Signed and Sealed this
Twenty-seventh Day of November, 2012

David J. Kappos

David J. Kappos
*Director of the United States Patent and Trademark Office*